US006808453B1

(12) United States Patent
Winfrey

(10) Patent No.: US 6,808,453 B1
(45) Date of Patent: Oct. 26, 2004

(54) COIN COLLECTING TRAY FOR A CASINO MACHINE

(76) Inventor: Evelyn M. Winfrey, 500 W. Walnut St., Raymore, MO (US) 64083

( * ) Notice: Subject to any disclaimer, the term of this patent is extended or adjusted under 35 U.S.C. 154(b) by 180 days.

(21) Appl. No.: 10/164,760

(22) Filed: Jun. 7, 2002

(51) Int. Cl.[7] ..... A63F 9/24
(52) U.S. Cl. ..... 463/20; 463/47
(58) Field of Search ..... 463/20, 46, 47, 463/25; 273/143 R, 148 R

(56) References Cited

U.S. PATENT DOCUMENTS 4,063,680 A 12/1977 Leo
4,846,333 A 7/1989 Kissick
4,974,761 A 12/1990 Luque
D329,783 S 9/1992 Ancona et al.
5,570,836 A 11/1996 Tai
5,715,928 A * 2/1998 Bradley ..... 194/344
5,826,743 A 10/1998 Baird
6,047,966 A * 4/2000 Hishinuma et al. ..... 273/143 R
6,578,847 B1 * 6/2003 Hedrick et al. ..... 273/138.2
2003/0032388 A1 * 2/2003 Rasmussen et al. ..... 453/63

* cited by examiner

*Primary Examiner*—Kim Nguyen

(57) ABSTRACT

A coin collecting tray for a casino machine providing a tray having sloped walls to form a coin collection trough within the tray. The interior of the tray is sloped to pool the collected coins together and the walls are designed to restrict access to the collected coins to prevent theft.

3 Claims, 4 Drawing Sheets

COIN COLLECTING TRAY FOR A CASINO MACHINE

BACKGROUND OF THE INVENTION

1. Field of the Invention

The present invention relates to coin trays and more particularly pertains to a new coin collecting tray for a casino machine for providing a tray to collect dispensed coins while restricting access to the collected coins to prevent theft.

2. Description of the Prior Art

Typically, casino machines have a token or coin distribution tray that is very broad, extending from one side of the machine to the other. Additionally, the bottom of these trays is typically flat which promotes wide distribution of coins or tokens over the bottom of the tray. Given the relative size of the tokens or coins to the total area of the bottom of the distribution tray, it is easy to miss or lose a coin in the bottom of the tray when attempting to remove the coins or tokens. Further, access is generally available from the sides of the tray which gives unscrupulous persons an opportunity to reach into the distribution tray to steal tokens or coins of a player while the player is playing.

The use of coin trays is known in the prior art. U.S. Pat. No. 5,826,743 describes a tray for use with a slot machine to facilitate insertion of coins into the slot machine. Another type of coin tray is U.S. Pat. No. Des. 276,092 disclosing an ornamental appearance for a coin tray and message display combination. U.S. Pat. No. Des. 285,859 also shows an ornamental appearance for a coin tray. U.S. Pat. No. 3,638,587 discloses a tray for a gaming table to hold poker chips. U.S. Pat. No. 4,026,309 teaches a tray having a trough and slit for counting specially structured chips having a light reflective perimeters corresponding to values of the chips.

While these devices fulfill their respective, particular objectives and requirements, the need remains for a tray that facilitates collection of tokens or coins from a casino machine into a single area of the tray while restricting access to the collected tokens by anyone other than the player of the machine.

SUMMARY OF THE INVENTION

The present invention meets the needs presented above by providing a tray having sloped walls to form a coin collection trough within the tray. Additionally, the walls are sufficiently high around sides of the tray to prevent access to the collected coins except from directly in front of the casino machine.

Still yet another object of the present invention is to provide a new coin collecting tray for a casino machine that provides a tray capable of displaying decorative patterns or advertising messages.

Even still another object of the present invention is to provide a new coin collecting tray for a casino machine that prevents loss of coins distributed by a casino machine by providing a tray sized and shaped to receive all coins distributed by the casino machine. The tray further has a curved protruding lip for gathering collected coins and distributing them at a single location to prevent spillage of collected coins when the tray is emptied by scooping coins out of the tray.

Yet even another object of the present invention is to provide a new coin collecting tray for a casino machine that can be produced as an upgrade or interchangeable replacement part for existing casino machines having old style or damaged coin collecting trays.

To this end, the present invention generally comprises a casino machine having a tray to catch coins dispensed from the casino machine. The interior of the tray is sloped to pool the collected coins together and the walls are designed to restrict access to the collected coins to prevent theft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
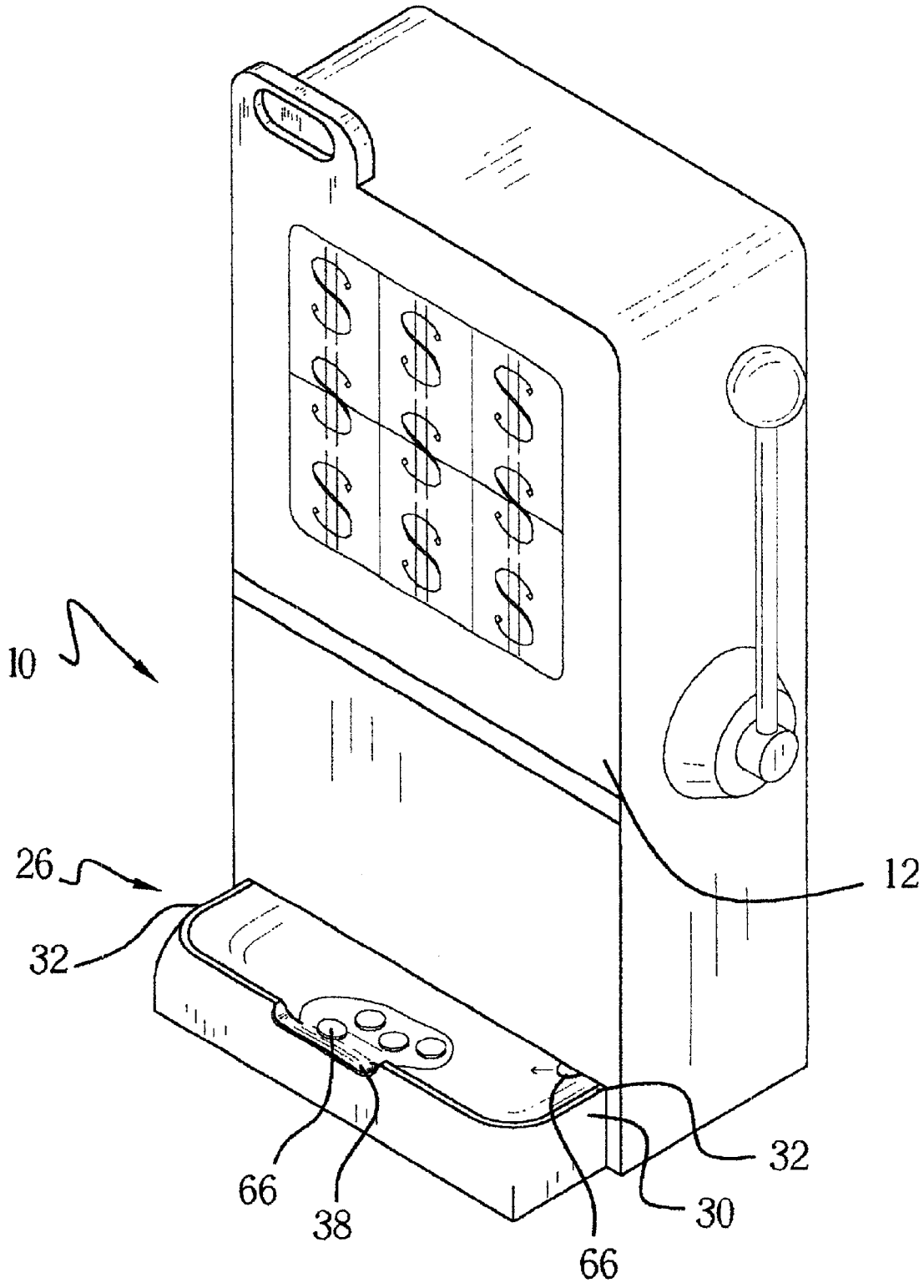
FIG. 1 is a perspective view of a new casino machine and coin collecting tray according to the present invention.
Figure 2:
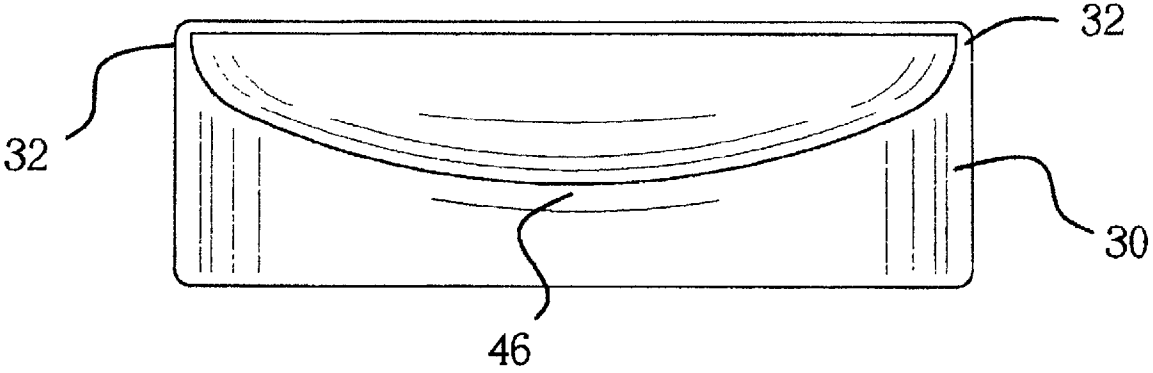
FIG. 2 is a front view of the tray of the present invention.
Figure 3:
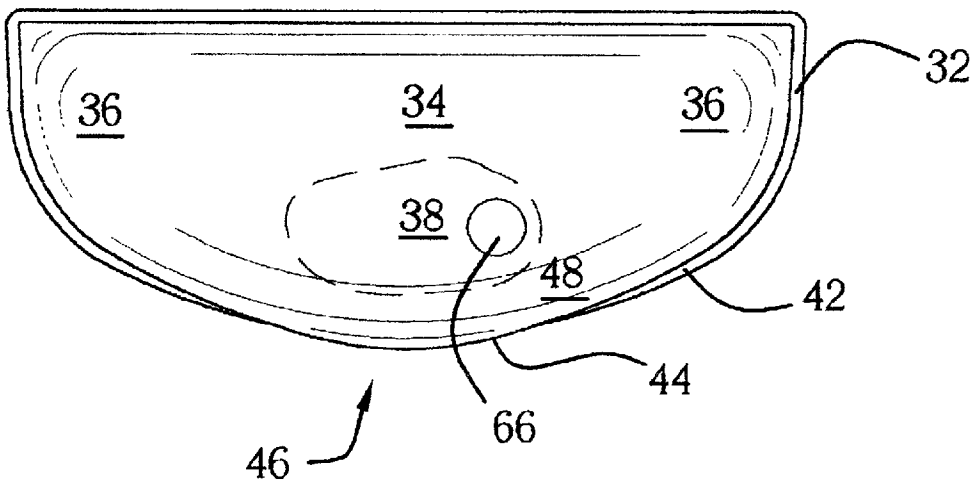
FIG. 3 is a top view of the tray of the present invention.
Figure 4:
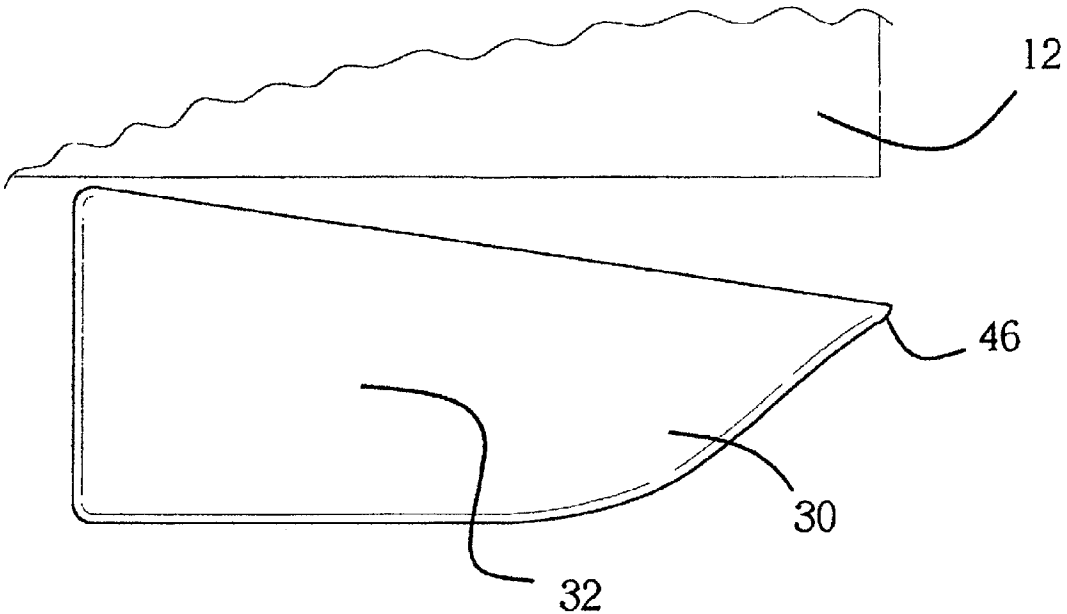
FIG. 4 is a side view of an embodiment of the tray of the present invention.
Figure 5:
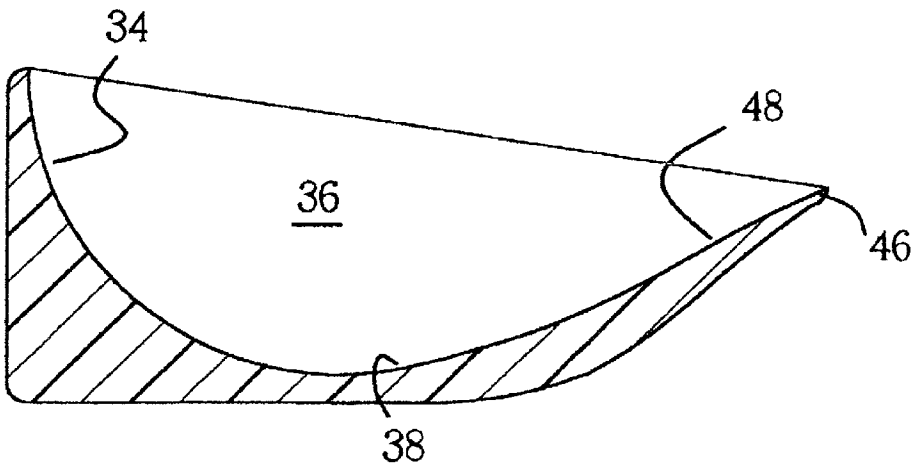
FIG. 5 is a side cross-sectional view showing the form of the interior walls of the removable tray of FIG. 4.
Figure 6:
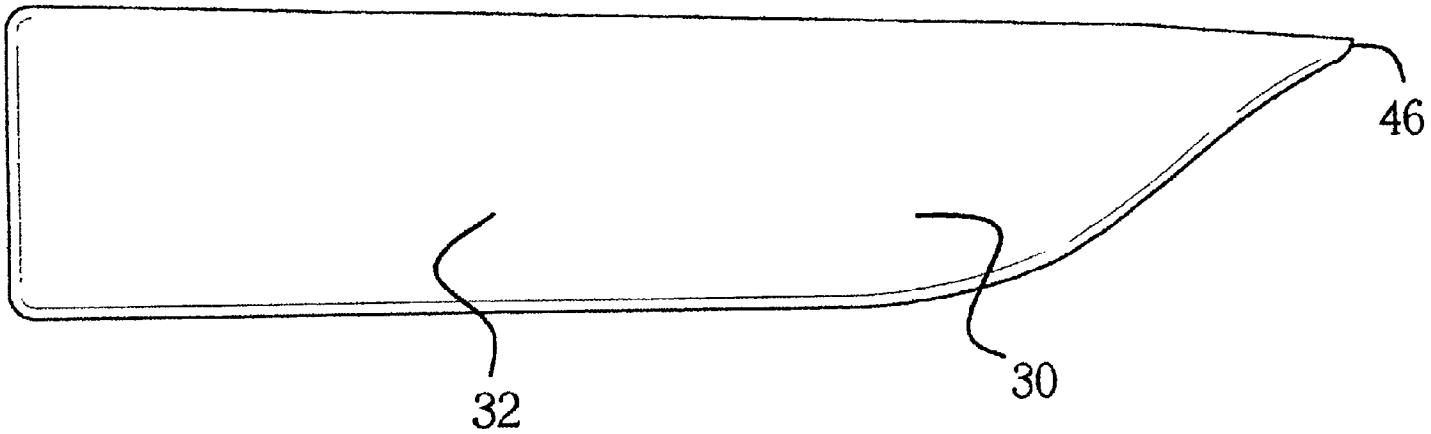
FIG. 6 is a side view of another embodiment of the removable tray of the present invention.
Figure 7:
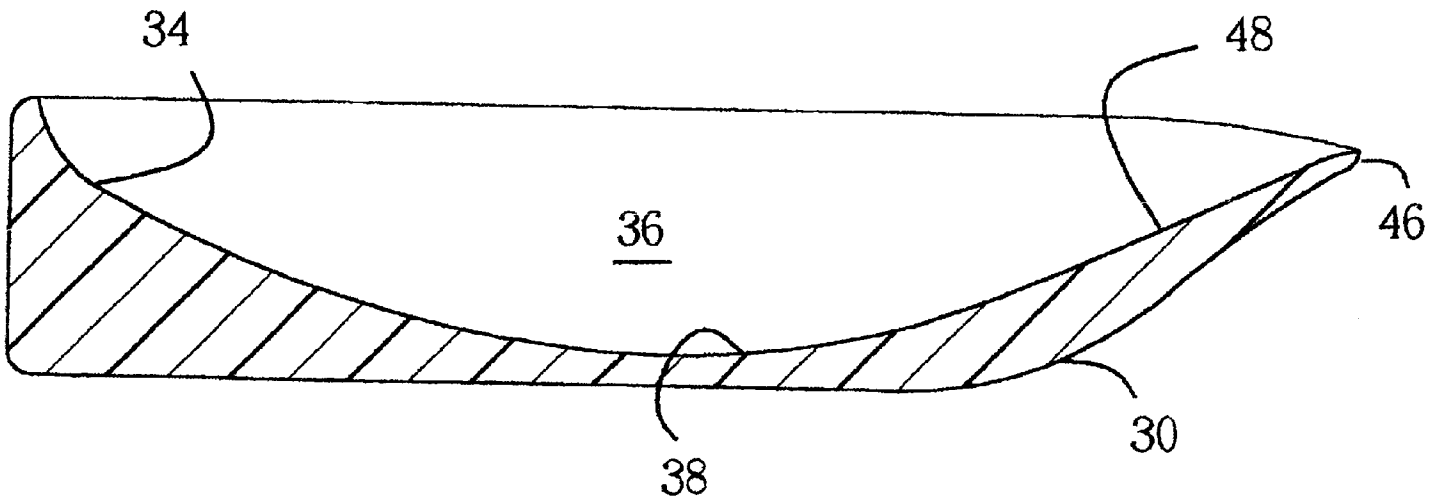
FIG. 7 is a cross-sectional view showing the form of the interior walls of the removable tray of FIG. 6.

With reference now to the drawings, and in particular to FIGS. 1 through 7 thereof, a new coin collecting tray for a casino machine embodying the principles and concepts of the present invention and generally designated by the reference numeral 10 will be described.

As best illustrated in FIGS. 1 through 7, the coin collecting tray for a casino machine 10 generally comprises a casino machine 12 that includes a token collection tray 30. The token collection tray 30 lines receives tokens 66 distributed by the casino machine 12. The token collection tray 30 includes side walls 32 extending upwardly from a bottom of the token collection tray 30 to restrict access to the coin collection tray over the side walls 32.

Interior rear and side wall surfaces 34 and 36 are curved to direct tokens 66 into a collection area 38 in a central forward area of the token collection tray 30.

A forward wall 42 of the token collection tray 30 includes an outwardly curved central portion 44 forming a lip 46. An interior surface 48 of the forward wall 42 is curved to direct collected tokens towards the lip 46 when the token collection tray 30 is tipped forward to distribute the collected tokens 66 from the token collection tray 30.

In use, the token collection tray 30 is attached to a casino machine as a replacement for the common style of flat open collection tray commonly used. The shape of the token collection tray 30 restricts access to distributed tokens or coins by anyone other than the player directly in front of the casino machine. Coins or tokens distributed by the casino machine fall into the token collection tray and the curvature of the interior walls collects the distributed coins or tokens in a collection area adjacent to a central access opening in the forward wall of the token collection tray. Tokens may be easily grasped or scooped from the token collection tray by the player using either the left or right hand when the player is directly in front of the casino machine.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A coin collecting tray for a casino machine, the coin collecting tray comprising:

a token collection tray positionable adjacent to the casino machine whereby said token collection tray receives tokens distributed by the casino machine, said token collection tray having side walls extending upwardly for restricting access to said token collection tray over said side walls; and said token collection tray having interior rear and side wall surfaces being curved for directing tokens into a collection area in a central forward area of said token collection tray, said interior rear and side wall surfaces comprising a concave surface such that said interior rear and side wall surfaces form a substantially bowl shaped depression is said coin collecting tray, said collection area being positioned at a bottom of said bowl shaped depression such that said collection area is positioned between a front edge, a rear edge and a pair of side edges of said token collection tray, said bowl shaped depression directing the tokens into said collection area from said front edge, said rear edge and said side edges when the tokens fall into said bowl shaped depression.

2. The coin collecting tray for a casino machine of claim 1, further comprising:

a forward wall of said token collection tray having an outwardly curved central portion forming a lip, an interior surface of said forward wall being curved to direct the collected tokens towards said lip when said token collection tray is tipped forward to distribute said collected tokens from said token collection tray.

3. A coin collecting tray for a casino machine, the coin collecting tray comprising:

a token collection tray positionable adjacent to the casino machine whereby said token collection tray receives tokens distributed by the casino machine, said token collection tray having side walls extending upwardly for restricting access to said token collection tray over said side walls;

said token collection tray having interior rear and side wall surfaces being curved for directing tokens into a collection area in a central forward area of said token collection tray, said interior rear and side wall surfaces comprising a concave surface such that said interior rear and side wall surfaces form a substantially bowl shaped depression is said coin collecting tray, said collection area being positioned at a bottom of said bowl shaped depression such that said collection area is positioned between a front edge, a rear edge and a pair of side edges of said token collection tray, said bowl shaped depression directing the tokens into said collection area from said front edge, said rear edge and said side edges when the tokens fall into said bowl shaped depression; and a forward wall of said token collection tray having an outwardly curved central portion forming a lip, an interior surface of said forward wall being curved to direct the collected tokens towards said lip when said token collection tray is tipped froward to distribute said collected tokens from said token collection tray.

* * * * *